United States Patent [19]

Been, Jr.

[11] 4,153,377

[45] May 8, 1979

[54] APPARATUS FOR AND METHOD OF DISSOLVING A SOLID IN A LIQUID

[76] Inventor: Lars J. Been, Jr., 11 Summit St., Glen Ridge, N.J. 07028

[21] Appl. No.: 844,521

[22] Filed: Oct. 25, 1977

[51] Int. Cl.[2] ..... B01F 7/16

[52] U.S. Cl. ..... 366/317

[58] Field of Search ..... 336/315–317, 336/302, 304, 264, 265, 325; 241/170–172, 296, 297, 46.11

[56] References Cited

U.S. PATENT DOCUMENTS

| | | | |
|---|---|---|---|
| 2,637,330 | 5/1953 | Webster | 366/325 |
| 2,918,264 | 12/1959 | Ackles | 366/317 X |
| 3,120,353 | 2/1964 | Neidl | 241/46.11 |
| 3,486,705 | 12/1969 | Szegvari | 366/317 |

*Primary Examiner*—Leonard D. Christian
*Attorney, Agent, or Firm*—George H. Mortimer

[57] ABSTRACT

The invention comprises a method of and apparatus for forming in a liquid a solution of another material which may be in solid, liquid or gaseous phase.

The method comprises establishing two zones of mixing with a partial rotating separator between them to cause rotation of the liquid around an axis and circulation within each zone due to the rotation of the separator and causing agitation within each zone by a plurality of axially extending rods which rotate in the liquid adjacent to the rotating separator.

The apparatus is a dissolver comprising a tank, a separator capable of rotating in the tank at various levels above the bottom thereof which is provided with a plurality of axially extending rods above and below the separator. The separator has a diameter within the range of 15% to 35% of the diameter of the tank; the rods are mounted thereon about 50% to 75% of the radial distance from the axis to the circumference of rotation; the rods extend upwardly and downwardly from the separator a distance within the range of about 50% to 100% of the radial distance from the axis and they have a diameter of 10% to 25% of the said radial distance. The separator is also a feature of the invention per se.

12 Claims, 3 Drawing Figures

APPARATUS FOR AND METHOD OF DISSOLVING A SOLID IN A LIQUID

INTRODUCTION

The present invention relates to apparatus for and a method of dissolving in a liquid another material which may be in gaseous, liquid or solid phase. More particularly, the apparatus comprises an open-top tank for holding a body of the liquid, a rotatable separator, means for mounting the separator for rotation round an axis and for up and down movement along said axis in said tank, said separator having a plurality of rods mounted therein substantially equidistant from the axis, and within the range of about 50 to 75 percent of the distance from the axis to the periphery thereof. These rods extend both upwardly and downwardly from the separator a distance within the range of about 50 percent to 100 percent of the radial distance of the rods from the axis of rotation. The rods have a diameter within the range of about 0.1 to 0.25 of the distance of their axes from the axis of rotation. The separator has a diameter of rotation within the range of about 15% to 35% of the diameter of the tank. The invention also embraces a separator, preferably a disk, having such rods mounted thereon, and which may, if desired, have peripheral means for breaking up the solids to be dissolved, and/or increasing the agitation produced by its rotation.

The method of the invention comprises dissolving a soluble material in gaseous, liquid or solid phase in a body of liquid by establishing about an axis an upper zone of circulation and a lower zone of circulation within the body of liquid containing the material (particles if in solid phase) to be dissolved by means rotating about the axis which physically separate said zones for a distance part way from the axis to the outer boundary of the body, and generating agitation within each zone adjacent to the rotating means at a distance from the axis within the range of 50 to 75 percent of the distance of said physical separation. The relative size of said zones may be increased and decreased to assist in the dissolution of the material in the liquid.

BACKGROUND OF THE INVENTION

Devices for mixing liquids to form solutions and/or emulsions and for dissolving and/or suspending gases and solids in liquids are known. In particular, devices of the type improved by the present invention are known which include an open-top tank and means extending downwardly through the open top to agitate the liquid in the tank to mix it with another material which may be in gaseous, liquid, or solid phase. Apparatus of this general type is disclosed in U.S. Pat. Nos. 2,651,582 and 2,787,448. A commercially available device of this type, known as the Cowle's Dissolver, comprises a hydraulic lift to raise and lower a motor driven shaft at the lower end of which various types of impellers may be removably secured for agitating liquids in an open-top tank into which the shaft and impeller are lowered by the hydraulic lift. Many different types of impellers are disclosed in the prior art among which are the devices described in U.S. Pat. Nos. 211,248, 1,354,489, 1,692,617, 2,201,947, 2,581,414, 2,697,589, 2,787,448, 2,918,264, 3,111,305, 3,318,248, 3,690,621. Devices are also known which comprise a tank having a generally rounded bottom in the center of which is an impeller driven from below as exemplified in U.S. Pat. Nos. 2,351,492, 2,665,853, 2,945,634, 3,009,656, 3,085,756 and 3,432,107. Pin mixers are also known as exemplified by U.S. Pat. Nos. 2,639,901 and 2,641,453 in which a disk is provided with a plurality of upwardly extending pins that rotate between downwardly extending pins on a cover for the mixing device.

All of the foregoing devices have serious deficiencies in producing mixtures of liquid with gasses, liquids or solids to produce solutions, emulsions, suspensions and the like, particularly when used in open-top tanks. Among other difficulties and disadvantages with impellers of the types known to the prior art are throwing of the liquid out of the tank, particularly when the impeller is raised to increase the size of the lower zone and decrease the size of the upper zone in the tank, slow and/or inadequate rate of dissolution of the solids in the liquid and lack of homogeniety in the mixture produced.

These difficulties and disadvantages have been overcome by the present invention.

BRIEF DESCRIPTION OF THE INVENTION IN CONJUNCTION WITH THE DRAWINGS

The invention will be described in conjunction with the drawings in which.

DETAILED DESCRIPTION OF PREFERRED EMBODIMENTS OF THE INVENTION

Figure 1:
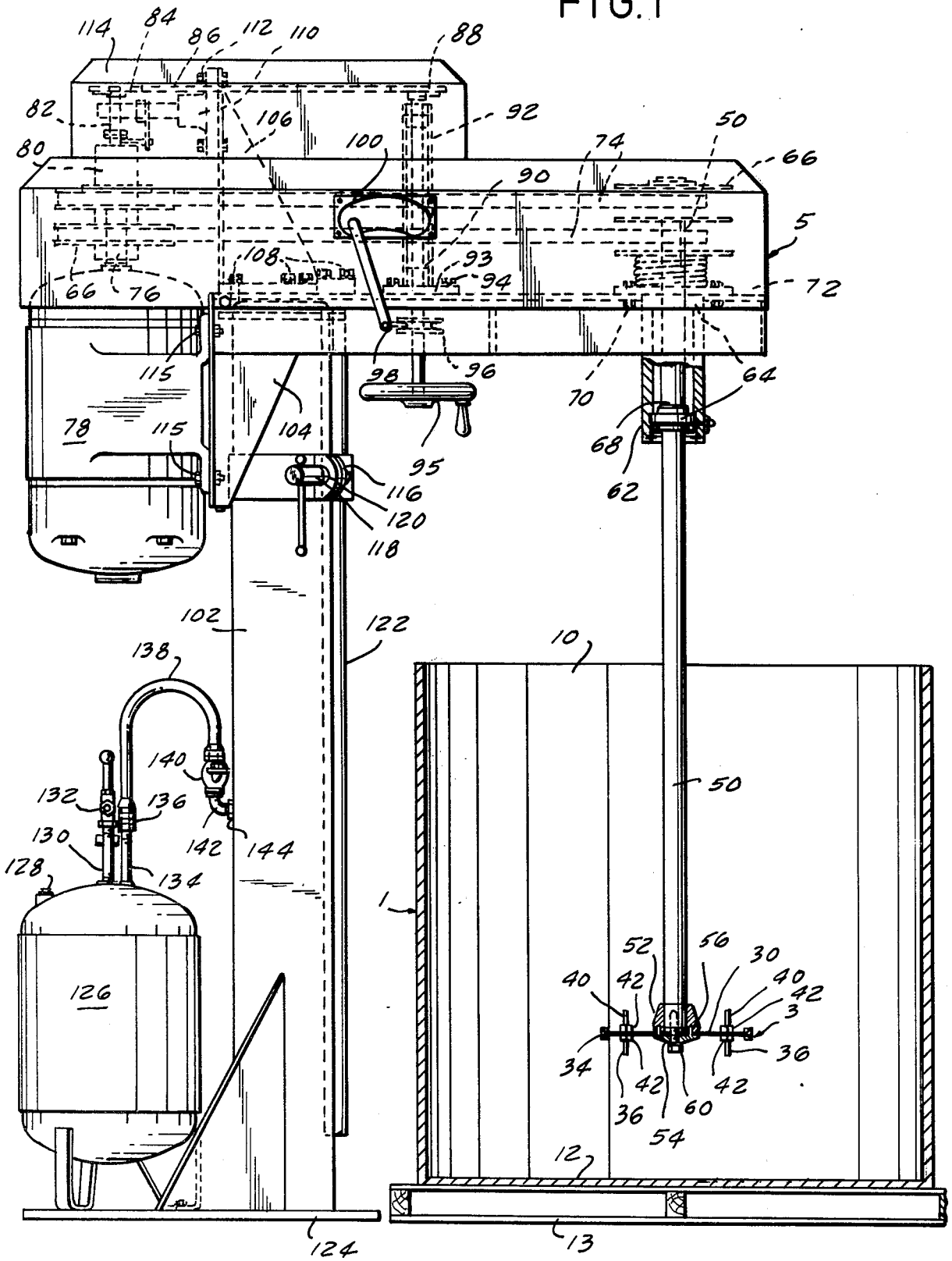
FIG. 1 is a side view, partly in section, of a dissolver embodying the invention.

There are many arts in which it is necessary to mix a liquid vehicle with another material. The liquid vehicle may be, and preferably is, a solvent for the other material such as an alcohol, ester, ketone, aromatic hydrocarbon, petroleum distillate, amide, amine, water, and the like. The other material may be in gaseous, liquid, or solid phase such as air, oil, natural and synthetic resins, chemical compounds, reaction products and the like. The product of the mixing operation may be a true solution, a colloidal solution, an emulsion, a suspension, and the like. Where the term "solution" and related words are used hereinafter, they are to be construed to embrace all these forms of products of the mixing operation. Similarly the term "dissolve" and related words are to be construed to embrace the making of colloidal solutions, emulsions, suspensions, etc., as well as solutions.

The method of forming a solution in a liquid of another material in accordance with the invention comprises forming a batch of the liquid containing the other material. Some form of holding vessel such as a tank is a convenient way of forming a batch of the liquid in which the other material is to be dissolved. At some stage in the mixing operation, all of the other material which is to be dissolved in the liquid is present in the mixing vessel. In some instances the two materials may be present at the start of the mixing operation; in other instances the other material may be added gradually to the batch of liquid; while in still other instances the other material may be placed in the vessel first and the liquid added before or over all or a portion of the time that the mixing operation is carried out. Where the other material to be dissolved in the liquid vehicle is in solid phase, it is generally advisable to divide the solid into particles which can then be added from a scoup or caused to flow through a suitable pipe or the like into the mixing vessel.

The mixing of the other material in the liquid within the mixing vessel is accomplished in accordance with the invention by establishing two zones of circulation, one above and the other below a rotating separating means which extends within the liquid from an axis of rotation substantially in a single plane outwardly part way to the periphery thereof. The diameter or other size of the separating means establishes the distance of physical separation of the two zones of circulation. Generally speaking, the diameter of revolution of the separating means is within the range of about 15% ot 35% of the diameter of the tank. The relative sizes of the two zones of circulation depends upon the height of the rotating separator above the bottom of the mixing vessel. It is advantageous in mixing the liquid vehicle with certain other materials to move the rotating separator up and down along the axis of rotation so as to increase and decrease the relative volumes of the liquid in the respective zones of circulation. For example, in mixing denser particles of a solid with a less dense liquid the separator is advantageously rotated near the bottom of the tank at the start and then raised toward the upper part of the mixture at a later stage of the mixing operation.

Agitation is generated within each of the zones of circulation by a plurality of axially extending rods rotating in each zone adjacent to the rotating separating means at a distance from the axis of rotation within the range of about 50% to 75% of the radius of rotation of the separating means, i.e., of the radial distance of said physical separation, and which have a length extending upwardly and downwardly from the rotating separating means, a distance within the range of about 50% to 100% of the radial distance of the rods from the axis of rotation. The rods preferably have a diameter within the range of 10% to 25% of the radial distance of their axis from the axis of rotation.

The mixing operation is carried out long enough to produce the solution desired, whereupon the product of the mixing operation is removed from the mixing vessel for further processing and/or use.

A preferred embodiment of the apparatus embodying the invention will be described in conjunction with FIG. 1 of the drawing and which comprises a mixing vessel 1, preferably in the form of a cylindrical tank with a flat bottom, a rotatable separator 3 and means 5 for mounting the separator 3 for rotation about an axis, preferably vertical or substantially vertical, and for up and down movement within the tank 1.

The tank 1 is open at the upper end or top and comprises a side wall 10, preferably cylindrical in shape, and a bottom 12 which closes the other end of the side wall opposite the open upper end. While a flat bottom tank is preferred, other shapes including hemispherical may be used if desired, and it may be advantageous to provide the tank 1 with casters for easy moving under the mixing means 5 and for removal therefrom for discharge of the contents. Another alternative for easy movement is to place the tank 10 on a fork lift platform 13, a dolly or the like, instead of providing casters on the tank itself.

The separator 3 serves as an impeller to produce circulation of the body of liquid in the tank 1. A preferred form of separator is a disk which may be imperforate except for holes to be described or perforated with holes for any desired purpose, but other shapes such as a triangle, a square, a star, a spider and the like may be used. The disk has relatively small axial thickness, as may be seen from the drawing, and may be said to be substantially in a single plane, even if the periphery is provided with teeth as later described. In any event, whatever the shape, the outermost point or points define a circumference of the zone of separation in accordance with the invention. The forces generated by the rotating separator 3 are of two general kinds. One is the drag force produced by contact of the liquid with the impeller which causes the liquid to rotate around an axis in line with the axis of rotation, and produces a circular motion in the body of liquid both above and below the separator. The second force acting upon the moving body of liquid is the centrifugal force generated by its rotation which is highest adjacent to the separator and which tends to cause circulation of the liquid in a radial direction adjacent to the separator, then downwardly at the periphery of the body of liquid, then back radially toward the axis of rotation and then upwardly to repeat the cycle.

Figure 2:
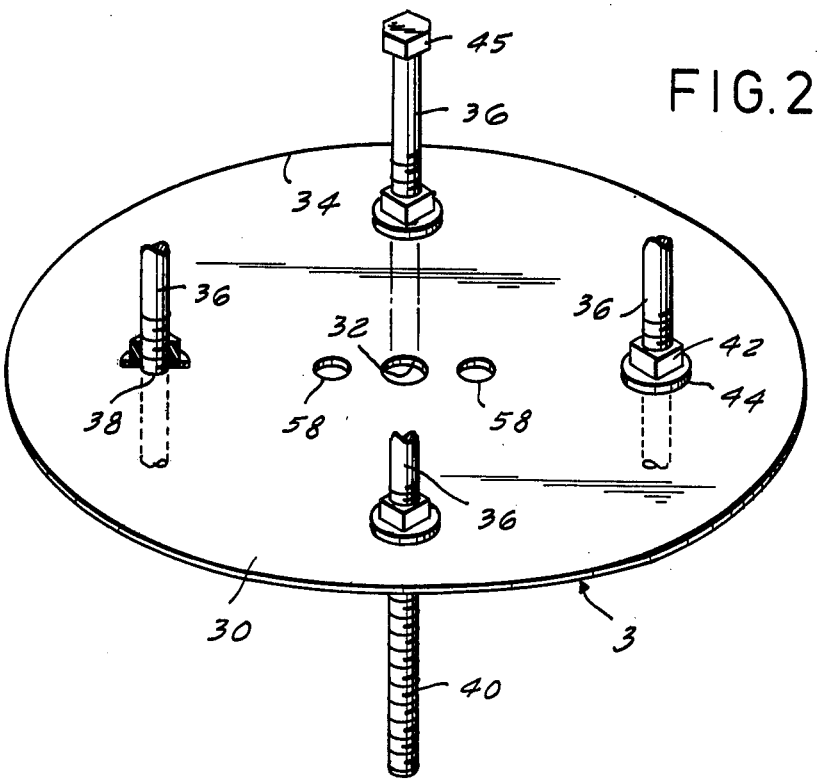
FIG. 2 is an isometric view of an impeller embodying the invention.
Figure 3:
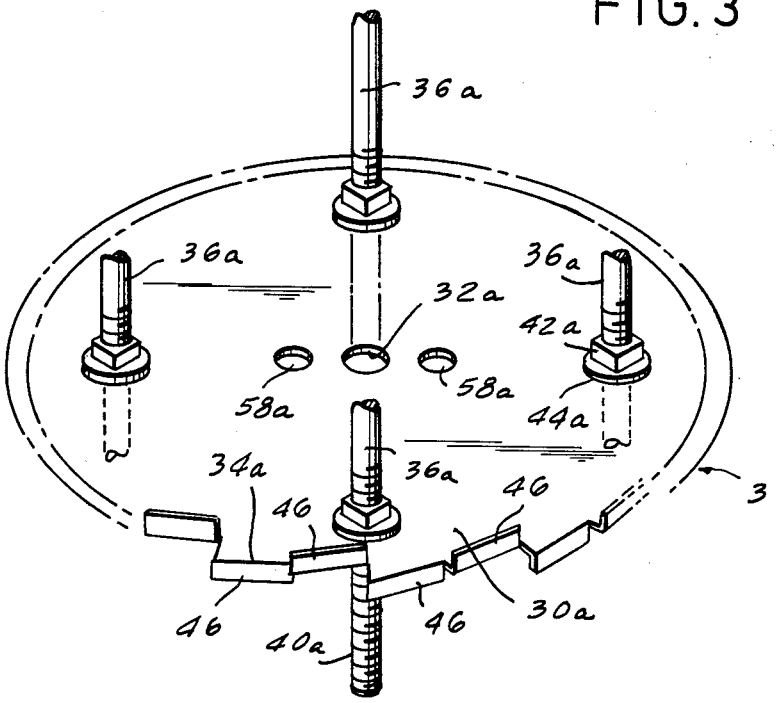
FIG. 3 is an isometric view of another impeller embodying the invention.

Referring now also to FIGS. 2 and 3 as well as FIG. 1, the impeller comprises a disk 30, **30*a*, having a central aperture 32, 32*a*, for mounting the disk on the end of a drive rod soon to be described. The periphery of the disk may be circular as shown at 34 in FIG. 2 or saw-toothed in shape as shown at 34*a* in FIG. 3. Agitating pins 36, 36*a*, are suitably mounted on the disk 3 so as to extend above and below the upper and lower surfaces of the disk respectively. These agitating pins may be mounted on the disk in any suitable way, and a very advantageous way is to drill a plurality of holes 38 through the disk and to secure threaded bolts 40, 40*a*, to the disk, e.g., by welding or by nuts 42, 42*a*, and lock washers 44, 44*a*, on each side of the disk so that the lock washers are tightly compressed between the nuts and the surface of the disk. Threaded bolts are usually provided with a head 45 which may be left on the threaded shank or cut off, as desired. These pins 36, 36*a*, have the effect of agitating the moving body of liquid in both the upper and lower zones of circulation within the tank 1** by a beating action which breaks up clusters of solid particles and greatly facilitates the dissolution of added material in the liquid vehicle. The beating action generates heat which also facilitates dissolution of the material in the liquid.

The forces imparting movement to the body of liquid in the zones of circulation above and below the disk can be increased by providing saw-teeth in the periphery of the disk, as illustrated in FIG. 3, particularly if the outer edge of the saw-tooth is provided with a flange 46 as shown in FIG. 3. In this embodiment of the invention, a flange 46 is bent upwardly on one tooth and downwardly on the two adjacent teeth so that half of the teeth are provided with the upwardly turned flange, and the other half are provided with the downwardly turned flange. One end of the flange 46 is closer to the axis of rotation than the other end, which gives the saw-toothed effect, and this structure causes the flange to exert strong forces to move the liquid.

It has been found to be very important that the bolts or other stirring rods be located at an intermediate position between the periphery of the disk and the axis of rotation. Generally speaking, satisfactory results are obtained when they are located at a distance within the range of 50 to 75% of the radial distance from the axis of rotation to the periphery of the disk. It is also very important that the stirring rods be long enough to produce a considerable agitation within the circulating body of liquid. In general, satisfactory results are obtained when the length of the rod above and below the surface of the disk is within the range of 50 to 100% of the radial distance of the rod from the axis of rotation. The impellers of FIGS. 2 and 3 are highly satisfactory in use.

The rods must be strong enough to withstand the forces to which they are subjected so they do not break under the stresses to which they are subject as they exert their beating action, break up clustered masses of particles and agitate and vibrate the mixture. It has been found that a rod having a diameter within the range of about 10% to 25% of their radial distance from the axis of rotation has this necessary strength and also functions properly in the manner described.

Disk 30 is made ⅛" steel having a 5" radius. The central aperture is ⅝" in diameter, and the holes 38 are centered three inches away from the center of the disk. The rods 40 are 5/16" by 4" threaded bolts, and they are mounted in the disk by means of nuts 42 above and below the disk with interposed split lock washers 44 which hold the nuts tightly in place despite the vibration inherent in the rotation thereof in the body of liquid.

The impeller 30*a* of FIG. 3 has a radius of 4 ½", the bolts are located in holes centered three inches from the center of the disk, the saw-teeth are about 1 ⅛" from tip to tip, the flanges 46 are about ¼" high, and the trailing end of the flange is about 174' closer to the center of the disk than the leading end as the disk is rotated. In this embodiment the flange 46 thus makes an angle of about twenty degrees with a chord connecting the adjacent leading ends of two adjacent flanges.

The means 5 for mounting the disk 3 for rotation about an axis comprises a shaft 50 having a hub 52 at the lower end thereof. For the purpose of holding the disk against the end of the shaft and to assure that is rotates with the shaft, a washer 54 is provided with two pins 56 adapted to pass through off center holes 58 in the disk 3 and into recesses in the hub 52. A cap screw 60 passes through the central hole in the washer and the hole 32 in the disk into a threaded recess in the end of the shaft 50 into which the cap screw is tightly turned. These parts securely fasten the disk to the shaft in non-rotating relation to the shaft, but in rotating relation to the tank.

The shaft 50 is rotably mounted near its upper end in a drive housing 62 by means of spaced bearings 64 and it carries at its upper end a speed selector shive 66. A snap ring 68 above the lower bearing 64 maintains the shaft 50 against downward movement in relation to the bearing 64.

The drive housing 62 is secured by means of bolted flange 70 to a bridge 72.

The speed selector shive 66 on shaft 50 is driven by means of V belts 74 by a similar speed selector shive 66 mounted on the shaft 76 of the motor 78 which is also secured to the bridge 72 in a manner soon to be described. Preferably there are two speed selector shives on the shaft 50 and on the shaft 76 connected by means of two V belts 74 as shown. Each shive comprises two disks having tapered opposed faces, and they can be moved toward and away from each other so that a V belt held between them can be caused to engage the sloping faces at varying distances from the axis of rotation by moving the pairs of disks toward and away from each other.

Means are provided for adjusting the distance between each pair of shive disks by moving the disks toward each other on one shaft while they are moved apart from each other on the other shaft. These adjusting means comprise a speed selector screw 80 which can be moved axially by a special screw 82 secured to a sprocket 84 which is driven by a drive chain 86 from sprocket 88 fastened at the upper end of rod 90 which is rotatably mounted in a rod housing 92 secured to the bridge 72 by means of a flange 93 and bolts 94. At the lower end of rod 90 a hand wheel 95 is keyed, and by rotating the hand wheel the speed selector screw 80 can be moved up and down to effect the speed adjustment previously referred to.

A glide 96 on rod 90 cooperates with a pointer 98 secured at the other end to a speed plate 100 to give a visual indication of the speed adjustment between the drive shaft of the motor and the shaft 50.

The bridge 72 is secured to a cylinder assembly 102 which comprises an outer housing and an inner piston (not shown) with means for providing fluid under pressure between the head of the piston and the housing to raise and lower it as oil is supplied to or withdrawn from the chamber in the housing above the head of the piston. Also secured to the bridge is a motor mount 104 and an adjusting screw bracket 106 by means of cap screws 108. A special screw mount 110 is secured by means of bolts 112 to the adjusting screw bracket 106.

A belt guard 114 covers all of the moving parts except the shaft 50 and disk 3 and the hand wheel 95.

The motor 78 is tightly fastened to the motor mount 104 by means of bolts 115.

A brake 116 is provided on the cylinder assembly 102 which can be tightened around it by means of clamping handle and screw 118. A bronze washer 120 is placed between the clamping handle and the ends of the break band which are pulled together when the screw is turned down tight.

A non-rotating rod 122 is secured to the cylinder assembly 102 on the exterior of the housing and passes up through the clamp 116. The lower end of the cylinder assembly 102 is mounted on a base plate 124 on which an air-oil tank 126 is also suitably mounted adjacent to the cylinder assembly. Tank 126 is fluid tight when properly connected as shown, but access to the interior can be had by means of a pipe plug 128 in the upper hemispherical end of the tank. Also connected to the hemispherical upper end, near the center thereof, is a nipple 130 for securing an air valve 132 to the tank so that air can be supplied under pressure to the upper part of the tank by means of an air valve 132.

Also mounted in the upper hemispherical end of tank 126 is an oil pipe 134 which extends into the tank almost to the bottom of the lower hemispherical end; and it is provided at the upper end thereof with a swivel adapter 136. Also attached to the adapter 136 is a hose 138 having an oil valve 140 at the other end thereof which is connected to the cylinder of the hydraulic lift by means of an L and a screw bracket 144.

The apparatus of FIG. 1 may be operated by turning on the oil valve 140 to lift the bridge and associated parts high enough to clear the tank so that it can be placed under the disk 3 while the bridge is lifted, whereupon the valve 140 may be turned to draw out the oil from the cylinder and permit the bridge to be lowered to its working position by reducing the air pressure in the upper part of the tank 126 so that the weight of the bridge and associated parts brings the disk to the position desired for the mixing operation. The materials to be mixed may then be introduced into the tank if they were not already present when the tank was brought into position, the motor 78 turned on and the speed adjusted by wheel 95 until the desired rate of rotation of the plate 3 is obtained; whereupon the mixing operation continues, optionally by moving the disk up and down in the tank by means of the cylinder assembly 102, as described, to set up the two zones of circulation and to effect the agitation by means of pins 36 both above and below the plate 3 which partially separates the liquid in the upper zone from the liquid in the lower zone.

The method of the invention and the use of the apparatus of the invention will be illustrated in connection with a specific example for preparing an intermediate used in a lacquer which comprises a solvent and a solid natural or synthetic resin or polymer in granular form.

A cylindrical tank having an internal diameter of about 36 inches and an interior height of about 36 inches was supplied with about 105 gallons of a petroleum distillate and with an amount of the granules to increases the volume to about 130 gallons. The motor 78 was turned on and the speed adjusted to give a rate of rotation of the disk 3 of about 3600 RPM. The disk used was the ten inch diameter impeller illustrated in FIG. 2 and specifically described herein above. The rotation of the disk 3 set up a relatively small lower circulating zone and a relatively large upper circulating zone at the start. The pins 36 set up vigorous agitation and vibration in both the upper and the lower zones of circulation. After the granules were pretty well distributed in the liquid the rotating disk was raised toward the upper part of the liquid but not high enough to entrain an undesirable amount of air. After a period of about 75 minutes, the resin was completely dissolved in the solvent.

The operation was repeated except that the disk 3 used in the second run was that of FIG. 3 as specifically described herein above. It too caused the formation of the two circulating zones within the tank and a thorough dissolution of the resin in the solvent was effected.

As compared with the mixing operation using the disk of FIG. 3 without the bolts, the pumping action or circulation of the liquid in the tank using the embodiment of the present invention was much better than it was without the bolts. There was no excessive swirl setup in the liquid in the apparatus embodying the invention. There was a reduced amount of undissolved particles of resin on the sides and bottom of the tank utilizing the apparatus of the present invention as compared to the same apparatus except that the pins were not present in the rotating disk.

The presence of the pins in the disk, and the agitation in the liquid in the tank which these pins produce, have the effect of raising the temperature of the liquid in the tank. For example, where the liquid was introduced into the tank at the temperature of about 70° F. in the storage room, the temperature rose within the range of about 100° to 200° F., depending on the materials used.

The invention has been described and illustrated in connection with certain specific embodiments, but those skilled in the art will recognize that variations and modifications may be made without departing from the invention as described, and such variations and modifications are contemplated as being within the scope of the appended claims.

Having thus described and illustrated the invention, what is claimed is:

1. A method of forming a solution in a liquid of another material which comprises forming a batch of liquid containing said other material, establishing upper and lower zones of circulation about an axis above and below a rotating separator substantially in a single plane extending within said batch of liquid from the axis of rotation outwardly part way to the periphery thereof within said batch of liquid, generating agitation within each zone by a plurality of axially extending rods rotating in each zone adjacent to said rotating separator at a distance from said axis within the range of 50% to 75% of the distance of said physical separation.

2. A method of forming a solution as set forth in claim 1 including varying the relative sizes of said zones during the mixing operation.

3. A method of dissolving particles of a soluble solid in a body of liquid which comprises establishing about an axis an upper zone of circulation and a lower zone of circulation within said body of liquid containing particles of solid to be dissolved by means rotating substantially in a single plane about said axis which physically separates said zones for a distance part way from the axis of rotation to the outer boundary of the body, generating agitation within each zone by a plurality of axially extending rods rotating in each zone adjacent to said rotating means at a distance from said axis within the range of 50% to 75% of the distance of said physical separation.

4. A method of dissolving particles of a soluble solid in a body of liquid as set forth in claim 3 including varying the relative sizes of said zones during the mixing operation.

5. A method of dissolving a soluble solid in a liquid vehicle which comprises placing the liquid vehicle in a tank, introducing into said liquid vehicle the soluble solid in particulate form, subjecting the liquid to circulation and agitation by rotating about an axis and moving up and down along said axis a disk substantially in a single plane having rods mounted therein substantially equidistant from said axis and within the range of about 50 to 75% of the distance from the axis to the periphery thereof, and extending upwardly and downwardly therefrom a distance within the range of 50% to 100% of the radial distance therefrom from the center of said disk.

6. A dissolver comprising a cylindrical tank, a separator having a circumference of rotation within the range of 15% to 35% of the diameter of the tank, means for mounting said separator for rotation around an axis and for movement up and down along said axis in said tank, said separator having a plurality of rods mounted thereon substantially in a single plane and equidistant from said axis about 50% to 75% of the distance from the axis to the circumference of rotation thereof and extending upwardly and downwardly therefrom a distance within the range of 50% to 100% of the radial distance of said rods from the center of said disk.

7. An impeller for a dissolver having means for rotating it about an axis and for moving it up and down along said axis which comprises a single metal separator substantially in a single plane having mounted therein a plurality of rods substantially equidistant from said axis about 50% to 75% of the distance from the axis to the circumference of rotation thereof, and extending upwardly and downwardly therefrom.

8. An impeller as set forth in claim 7 in which the rods extend upwardly and downwardly from the separator a distance within the range of about 50% to 100% of the radial distance thereof from the center of said disk.

9. An impeller as set forth in claim 7 in which said separator is a disk having a smooth periphery.

10. An impeller as set forth in claim 7 in which said separator is a disk, the periphery of which is saw-toothed.

11. An impeller as set forth in claim 10 in which the saw-teeth are provided with alternate upwardly and downwardly extending flanges.

12. An impeller for a dissolver having means for rotating it about an axis which comprises a single metal disk substantially in a single plane having a radius within the range of 3 to 6 inches, a central opening in said disk for securing it to a rotating shaft of said means, a plurality of 5/16" holes in said disk spaced equidistantly from each other and spaced equidistantly from the center of the disk at a distance within the range of 50% to 75% of the distance from the center to the periphery of the disk, and a threaded rod mounted centrally in each of said 5/16" diameter holes and means for securing said rods in said disk.

* * * * *

UNITED STATES PATENT AND TRADEMARK OFFICE

CERTIFICATE OF CORRECTION

PATENT NO. : 4,153,377

DATED : May 8, 1979

INVENTOR(S) : Lars J. Been, Jr.

It is certified that error appears in the above-identified patent and that said Letters Patent are hereby corrected as shown below:

Column 5, line 31, "174'" should read -- 1/4" --.

Signed and Sealed this

*Seventeenth* Day of *July 1979*

[SEAL]

*Attest:*

*Attesting Officer*

LUTRELLE F. PARKER

*Acting Commissioner of Patents and Trademarks*